US009082342B2

(12) United States Patent
Qi et al.

(10) Patent No.: US 9,082,342 B2
(45) Date of Patent: Jul. 14, 2015

(54) AMOLED PANEL AND DRIVING CIRCUIT AND METHOD THEREFOR

(75) Inventors: Xiaojing Qi, Beijing (CN); Wen Tan, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 254 days.

(21) Appl. No.: 13/529,277

(22) Filed: Jun. 21, 2012

(65) Prior Publication Data

US 2012/0327064 A1 Dec. 27, 2012

(30) Foreign Application Priority Data

Jun. 21, 2011 (CN) ..... 2011 1 0168038

(51) Int. Cl.
*G09G 3/30* (2006.01)
*G09G 3/32* (2006.01)

(52) U.S. Cl.
CPC ..... *G09G 3/32* (2013.01)

(58) Field of Classification Search
USPC ..... 345/76, 82, 211, 212
See application file for complete search history.

(56) References Cited

U.S. PATENT DOCUMENTS

| | | | | |
|---|---|---|---|---|
| 8,026,874 | B2 * | 9/2011 | Yamashita et al. | 345/76 |
| 2004/0026723 | A1 | 2/2004 | Miyazawa | |
| 2011/0164071 | A1 * | 7/2011 | Chung et al. | 345/690 |

FOREIGN PATENT DOCUMENTS

| | | | |
|---|---|---|---|
| CN | 1482586 | A | 3/2004 |
| CN | 101536070 | A | 9/2009 |
| CN | 101996579 | A | 3/2011 |

OTHER PUBLICATIONS

Second Chinese Office Action dated Jun. 17, 2014; Appln. No. 201110168038.6.

Third Chinese Office Action dated Dec. 9, 2014; Appln. No. 201110168038.6.

First Chinese Office Action dated Dec. 4, 2013; Appln. No. 201110168038.6.

Chinese Rejection Decision dated Apr. 24, 2015; Appln. No. 201110168038.6.

* cited by examiner

*Primary Examiner* — Pegeman Karimi

(74) *Attorney, Agent, or Firm* — Ladas & Parry LLP

(57) ABSTRACT

Embodiments of the present disclosure relates to an active matrix organic light emitting diode (AMOLED) panel and the driving circuit and method therefore. The driving circuit of the AMOLED panel comprises: a driving transistor; a first transistor; a second capacitor; an organic light emitting diode; a voltage adjustment module, which is connected to a first control signal terminal, a second control signal terminal and a high level signal terminal, and is connected with the second capacitor, the driving transistor and the first transistor, for adjusting a gate-source voltage of the driving transistor connected with the second capacitor, such that a driving current of the driving transistor in a saturation status is independent of its threshold voltage.

20 Claims, 7 Drawing Sheets

AMOLED PANEL AND DRIVING CIRCUIT AND METHOD THEREFOR

BACKGROUND

One or more embodiments of the present disclosure relate to an active matrix organic light emitting diode (AMOLED) panel, a driving circuit and driving method for the AMOLED panel.

As compared with conventional thin film transistor liquid crystal display (TFT-LCD) panels, AMOLED panels have advantages such as faster response speed, higher contrast, wider view angles, and so on, and thus are regarded as the next generation of display technology, drawing much attention from most of the developers in display technology.

A sub-pixel unit of an AMOLED panel emits light is driven by a driving circuit. A conventional 2T1C driving circuit for each sub-pixel unit comprises two transistors (2T) and one capacitor (1C), as illustrated in FIG. 1. In FIG. 1, a transistor M1 acts as a switching transistor, a transistor M2 acts as a driving transistor, and a capacitor C acts as a storage capacitor. The transistor M1 is controlled by a row scan line signal Vscan so as to control the input of a data voltage Vdata. The transistor M2 is used for controlling an organic light emitting diode (OLED) to emit light. The storage capacitor C is used for providing a maintaining voltage to the gate of the transistor M2.

FIG. 2 is a control timing chart of the conventional 2T1C driving circuit in FIG. 1. The operation procedure of the 2T1C driving circuit is as follows. Two stages T1, T2 in FIG. 2 are taken for example, wherein the stage T1 is a writing stage of the display data voltage and the stage T2 is a display maintaining stage. During the stage T1, the row scan line signal Vscan is at a high level, and the transistor M1 is turned on, thus the data voltage Vdata charges the storage capacitor C and the data voltage Vdata is transferred to the gate of the transistor M2 at the same time, such that the transistor M2 works in a saturation status, and the organic light emitting diode (OLED) is driven to emit light. During the stage T2, the row scan line signal Vscan is changed to a low level, and the transistor M1 is turned off, so the data voltage Vdata cannot reach the gate of the transistor M2 and the storage capacitor C provides the gate of the transistor M2 with the maintaining voltage, such that the transistor M2 continues to work in the saturation status, which makes the OLED emit light continuously. Thereafter, the 2T1C driving circuit repeats the stage T2 until next stage T1 arrives.

It can be known from the above that the OLED in each pixel of the AMOLED panel is capable of emitting light with a driving current generated when the driving transistor M2 works in the saturation status. In particular, the driving current (i.e., the current flowing through the OLED) $I=K(V_{gs}-V_{th})^2$, wherein $V_g$, is a voltage difference between the gate and source of the transistor M2, $V_{th}$ is a threshold voltage of the transistor M2, and K is a constant related to the structure and the manufacturing process of the transistor M2 per se. At present, the threshold voltages $V_1$, of transistors have bad uniformity in the low temperature poly-silicon process, and may shift in usage, thus different threshold voltages of the transistor M2 result in different driving currents over time even if a same data voltage Vdata is input to the gate of the transistor M2, which makes worse brightness uniformity for the AMOLED panel.

SUMMARY

One or more embodiments of the present disclosure provide an active matrix organic light emitting diode (AMOLED) panel and a driving circuit and a driving method for the panel so as to improve the brightness uniformity of the AMOLED panel.

According to an aspect of the disclosure, a driving circuit of an active matrix organic light emitting diode panel comprising, a driving transistor, a first transistor, a second capacitor, an organic light emitting diode, and a voltage adjustment module, wherein the driving transistor comprises a gate which is connected to the second capacitor, a source which is connected to a low level signal terminal, and a drain which is connected to the voltage adjustment module; the first transistor comprises a gate which is connected to a row scan signal terminal, a source which is connected to the voltage adjustment module, and a drain which is connected to a data signal terminal; the second capacitor is connected between the gate of the driving transistor and the low level signal terminal; the organic light emitting diode is connected between the low level signal terminal and a juncture of the source of the driving transistor with the second capacitor, or is connected between a high level signal terminal and the drain of the driving transistor; and the voltage adjustment module is connected to a first control signal terminal, a second control signal terminal and the high level signal terminal, and further is connected with the second capacitor, the gate of the driving transistor, and the source of the first transistor, for adjusting a gate-source voltage of the driving transistor connected with the second capacitor, such that a driving current of the driving transistor in a saturation status is independent of the threshold voltage of the driving transistor.

According to another aspect of the disclosure, an active matrix organic light emitting diode panel comprises a plurality of sub-pixel units arranged in matrix, and one driving circuit as mentioned above is provided to each of the sub-pixel units.

According to further another aspect of the disclosure, a driving method for an active matrix organic light emitting diode (AMOLED) panel comprising driving the AMOLED panel with the driving circuit as described above for each sub-pixel units of the AMOLED panel, such that a driving current of the driving transistor under a saturation status in the driving circuit is independent of the threshold voltage of the driving transistor.

In the active matrix organic light emitting diode panel and the driving method and the driving circuit therefor in one or more embodiments of the present disclosure, the driving current of the driving transistor in the driving circuit in the saturation status can be independent of its threshold voltage, thus the threshold voltage $V_{th}$ will not affect the current flowing through an organic light emitting diode, so that the consistency (or uniformity) of the driving circuit can be ensured in a better way, which renders good AMOLED brightness uniformity.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the following detailed description.

BRIEF DESCRIPTION OF THE DRAWINGS

The present disclosure will become more fully understood from the detailed description given hereinafter and the accompanying drawings which are given by way of illustration only, and thus are not limitative of the present disclosure and wherein.

DETAILED DESCRIPTION

The active matrix organic light emitting diode (hereinafter called as AMOLED) and the driving method and circuit thereof according to the embodiments of the present disclosure will be described below in details with reference to the accompanying figures. The description is made only for the purpose of illustration but not in a limitative way.

Figure 1:
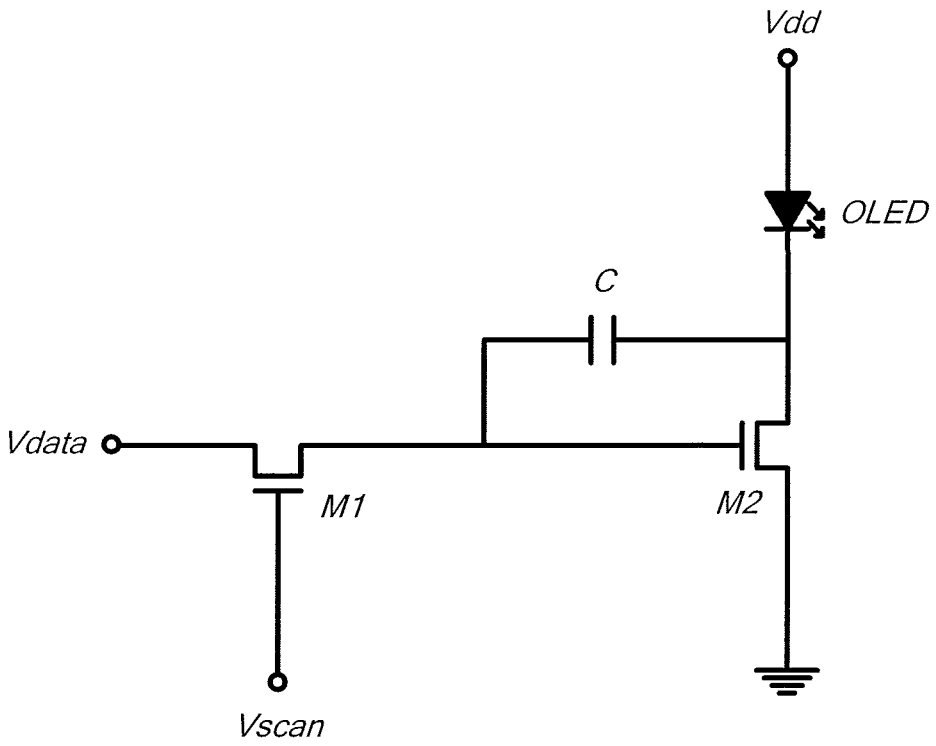
Fig.1 (Prior Art)
FIG. 1 is a schematic diagram of a conventional 2T1C driving circuit.
Figure 2:
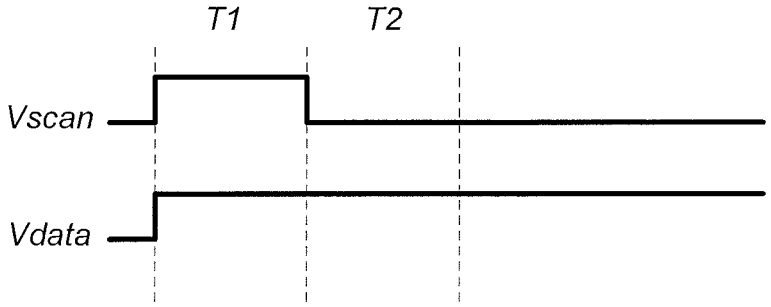
Fig.2 (Prior Art)
FIG. 2 is a control timing chart of the 2T1C driving circuit illustrated in FIG. 1.
Figure 3:
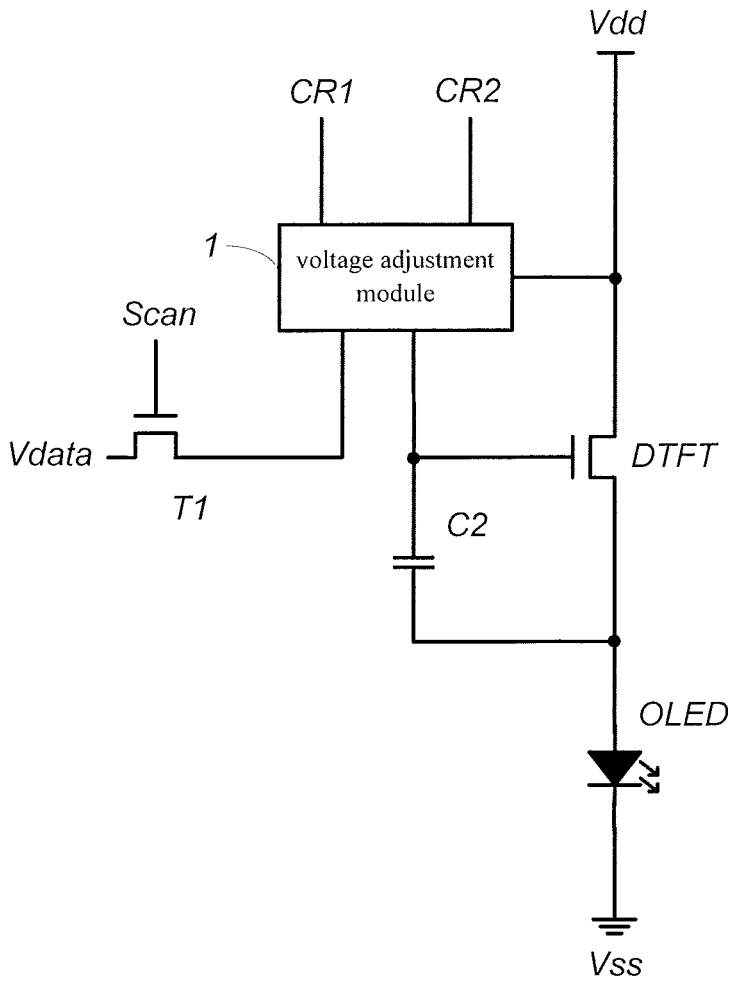
FIG. 3 is a schematic diagram of an AMOLED driving circuit according to an embodiment of the present disclosure.

FIG. 3 is a schematic diagram of an AMOLED driving circuit according to an embodiment of the present disclosure. The driving circuit according to the present embodiment is for example used in a sub-pixel of an AMOLED panel and includes two transistors, one capacitor, one organic light emitting diode (OLED), one voltage adjustment module, and input and output terminals. The AMOLED comprises multiple sub-pixels arranged in matrix for example. In each AMOLED driving circuit, the respective input and output terminals include a row scan signal terminal Scan, a data signal terminal Vdata, a first control signal terminal CR1, a second control signal terminal CR2, a high level signal terminal Vdd, and a low level signal terminal Vss. In particular, the AMOLED driving circuit includes the following components and configuration.

A driving transistor DTFT comprises a gate connected to a second capacitor C2, a source connected to the low level signal terminal Vss, and a drain connected to a voltage adjustment module 1; the driving transistor DTFT acts as a driving transistor for providing a driving current when it works in a saturation status to drive the OLED to emit light. A first transistor T1 comprises a gate connected to the row scan signal terminal Scan, a source connected to the voltage adjustment module 1, and a drain connected to the data signal terminal Vdata; the transistor T1 is used as a switching transistor for controlling the input of the data signal terminal Vdata under the control of the row scan signal terminal Scan. A second capacitor C2 is connected between the gate of the driving transistor DTFT and the low level signal terminal Vss, and is used for providing a maintaining voltage to the gate of the driving transistor DTFT. An organic light emitting diode (OLED) is connected between the low level signal terminal Vss and a juncture of the source of the driving transistor DTFT with the second capacitor C2 (see FIGS. 3 and 4), i.e., the source of the driving transistor DTFT is connected to the second capacitor C2 and then connected to the organic light emitting diode (OLED); or in another example, the OLED is connected between a high level signal terminal Vdd and the drain of the driving transistor DTFT (see FIG. 10). The OLED can emit light under the action of the driving current of the driving transistor DTFT whereby the whole AMOLED panel can operate to display. The voltage adjustment module 1 is connected to the first control signal terminal CR1, the second control signal terminal CR2 and the high level signal terminal Vdd, and further is connected with the second capacitor C2, the gate of the driving transistor DTFT and the source of the first transistor T1; and this voltage adjustment module 1 is used for adjusting the gate-source voltage $V_{gs}$ of the driving transistor DTFT connected with the second capacitor C2, such that the driving current I of the driving transistor DTFT in a saturation status is independent of the threshold voltage $V_{th}$ of the driving transistor DTFT.

In the embodiments of the AMOLED driving circuit of the present disclosure, since the gate-source voltage $V_{gs}$ of the driving transistor DTFT connected with the second capacitor C2 can be adjusted by the voltage adjustment module 1 so as to render the driving current I of the driving transistor DTFT in the saturation status independent of the threshold voltage $V_{th}$ of DTFT, the threshold voltage $V_{th}$ of the driving transistor DTFT will not affect the current flowing through the OLED, thus a consistency of the driving circuit I can be maintained in a better way, which gives rise to the better brightness uniformity of the AMOLED panel.

Figure 4:
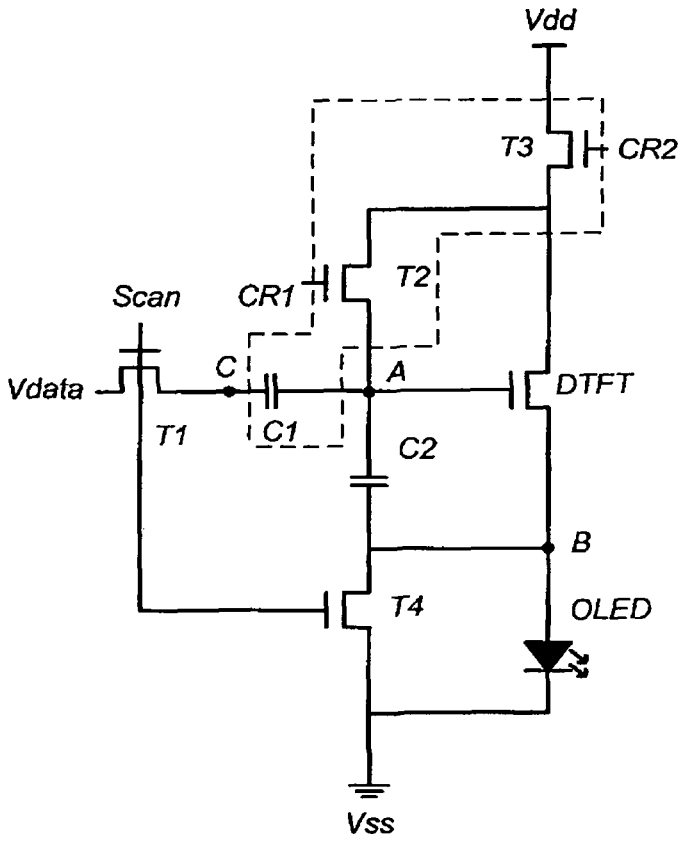
FIG. 4 is a schematic diagram of one embodiment of an AMOLED driving circuit.

FIG. 4 is a schematic diagram of one specific embodiment of an AMOLED driving circuit. As known from FIG. 4, the AMOLED driving circuit includes five transistors, two storage capacitors, one light emitting element, and input and output terminals. In FIG. 4, the five transistors include a driving transistor DTFT, a first transistor T1, a second transistor T2, a third transistor T3, and a fourth transistor T4 respectively. The storage capacitors include a first capacitor C1 and a second capacitor C2. The light emitting element is an organic light emitting diode (OLED). The input and output terminals include a row scan signal terminal Scan, a data signal terminal Vdata, a first control signal terminal CR1, a second control signal terminal CR2, a high level signal terminal Vdd, and a low level signal terminal Vss.

The configuration of the AMOLED driving circuit in the present embodiment is as the following. The driving transistor DTFT comprises a gate connected to the second capacitor C2, a source connected to the low level signal terminal Vss and a drain connected to the source of the third transistor T3. The first transistor T1 comprises a gate connected to the row scan signal terminal Scan, a source connected to the first capacitor C1, a drain connected to the data signal terminal Vdata. The second transistor T2 comprises a gate connected to the first control signal terminal CR1, a source connected to the second capacitor C2 (and is connected with the first capacitor C1 and the gate of the driving transistor DTFT at the same time), a drain connected to the drain of the driving transistor DTFT (and is connected with a source of third transistor T3 at the same time). The third transistor T3 comprises a gate connected to the second control signal terminal CR2, a source connected to the drain of the driving transistor DTFT (and is connected with the drain of the second transistor T2 at the same time), and a drain connected to the high level signal terminal Vdd. The fourth transistor T4 comprises a gate connected to the row scan signal terminal Scan, a source connected to one end of the organic light emitting diode (OLED) and the low level signal terminal Vss, and a drain connected to the other end of the OLED and the source of the transistor DTFT. The first capacitor C1 is connected between the source of the first transistor T1 and the second capacitor C2 (and at the same time the end adjacent to the second capacitor C2 is also connected with the gate of the driving transistor DTFT and the source of the second transistor T2). The second capacitor C2 is connected between the gate of the driving transistor DTFT and the source of the driving transistor DTFT (and the end adjacent to the gate of the transistor DTFT is also connected to the first capacitor C1 and the source of the second transistor T2, and the other end adjacent to the source of the transistor DTFT is also connected to the drain of the fourth transistor T4). The OLED is connected between the low level signal terminal Vss and a juncture of the source of the driving transistor DTFT with the second capacitor C2. In particular, the source of the driving transistor DTFT is connected with the second capacitor C2 and then with the OLED, as illustrated in FIG. 4.

In FIG. 4, the second transistor T2, the third transistor T3 and the first capacitor C1 together constitute the voltage adjustment module 1 in the present embodiment. The voltage adjustment module 1 adjusts the gate-source voltage $V_{gs}$ of the driving transistor DTFT connected with the second capacitor C2, such that the driving current I of the driving transistor DTFT in the saturation status can be independent of the threshold voltage $V_{th}$ of the driving transistor DTFT. Therefore, although $I=K(V_{gs}-V_{th})^2$, the threshold voltage $V_{th}$ of the driving transistor DTFT will not affect the current flowing through the OLED when the OLED is emitting light by addition of the voltage adjustment module, so that the consistency of the driving circuit I can be ensured in a better way, which brings about good AMOLED brightness uniformity.

The source and drain of the fourth transistor T4 are connected to the two ends of the OLED, respectively, and therefore the OLED is shorted when the driving transistor DTFT generates an incorrect driving current to prevent the OLED from emitting light under the action of the incorrect driving current and generating incorrect luminous strength, which may result in abnormal display. Further, the OLED is in connectivity with the driving transistor DTFT when the driving transistor DTFT generates a correct driving current, so that the OLED emits light under the action of the correct driving current, which ensures normal display.

A first node A is set between the first capacitor C1 and the second capacitor C2, and also is connected with the gate of the driving transistor DTFT and the source of the second transistor T2. A second node B is set between the source of the driving transistor DTFT and the OLED, and is also connected with the second capacitor C2 and the drain of the fourth transistor T4. A third node C is set between the first capacitor C1 and the source of the first transistor T1. The first node A, the second node B and the third node C can facilitate to describe and calculate circuit parameters (such as voltages at respective nodes) of the AMOLED driving circuit in the following.

For example, all of the driving transistor DTFT, the first transistor T1, the second transistor T2, the third transistor T3 and the fourth transistor T4 may be N-type transistors, which can be turned on under a high level signal and turned off under a low level signal.

In terms of functions of the transistors in the AMOLED driving circuit, the first transistor T1, the second transistor T2, the third transistor T3 and the fourth transistor T4 are switching transistors for turning on or off circuit connections. Thus, in the AMOLED driving circuit illustrated in FIGS. 6-9, the first to fourth transistors T1-T4 are simplified, i.e., the transistors that are turned off are omitted (not shown in the FIGS. 6-9), and the transistors that are turned on are simplified as conductive lines. The driving transistor DTFT is a driving transistor for generating the driving current to drive the OLED to emit light when this transistor is operating in the saturation status. It should be noted that the driving transistor DTFT and the first to fourth transistors T1-T4 are substantially the same in fabrication processes and structures, and they are named differently here only for distinguishing their functions in the AMOLED driving circuit.

Figure 5:
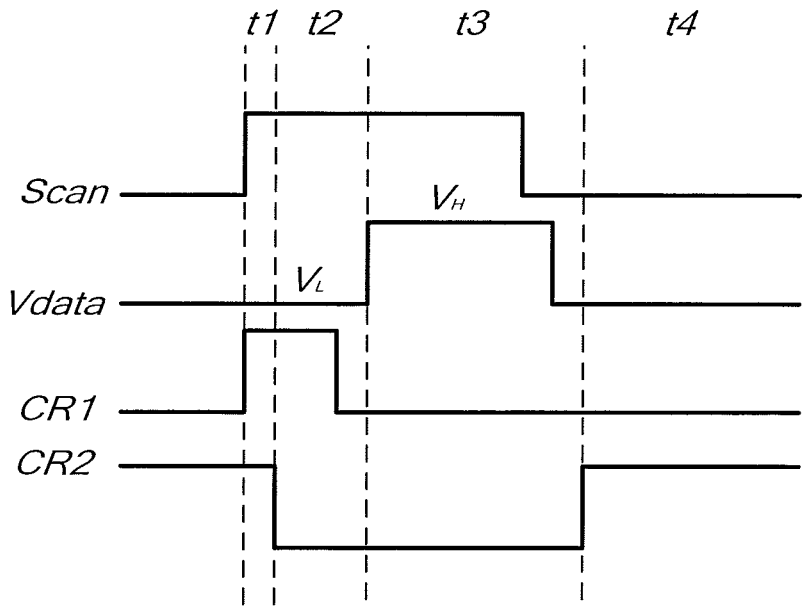
FIG. 5 is a control timing chart of the AMOLED driving circuit illustrated in FIG. 4.

FIG. 5 is a control timing chart of the AMOLED driving circuit in the present embodiment, and four stages t1 to t4 are selected for example. In the following descriptions, the high level signal is represented with digit "1," and the low level signal is represented with digit "0." The operation of the AMOLED driving circuit is described as follows with reference to FIGS. 5 and 6-9.

During the stage t1, Scan=1, $V_{data}$ $V_L$, CR1=1, and CR2=1.

Figure 6:
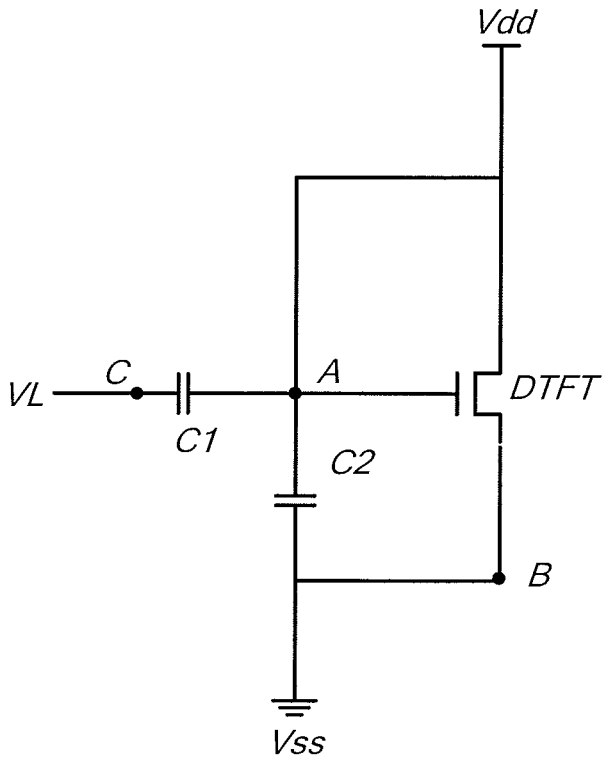
FIG. 6 is a schematic diagram of operation of the AMOLED driving circuit illustrated in FIG. 4 in stage t1.

The stage t1 is a pre-charge stage. As illustrated in FIG. 6, during the stage t1, since the row scan signal terminal Scan is at the high level, both of the first transistor T1 and the fourth transistor T4 are turned on; since the first control signal terminal CR1 is at the high level, the second transistor T2 is turned on; since the second control signal terminal CR2 is at the high level, the third transistor T3 is turned on. At this time, the low level data "$V_L$" is input from the data signal terminal Vdata to the first capacitor C1 via the first transistor T1; the high level signal from the high level signal terminal Vdd reaches the first node A via the third transistor T3 and the second transistor T2, and the driving transistor DTFT is turned on due to this high level signal. At this time, the gate and drain of the driving transistor DTFT are connected through the second transistor T2, thus the gate voltage and the drain voltage of the driving transistor DTFT are identical to each other, i.e., the gate-source voltage $V_{gs}$ equals to the drain-source voltage $V_{ds}$ of the driving transistor DTFT, which can satisfy $V_{ds} \geq V_{gs}-V_{th}$. Therefore, the driving transistor DTFT operates in the saturation status, the driving transistor DTFT in the saturation status generates a driving current of $I=K(V_{gs}-V_{th})^2=K(V_{qn}-V_{th})^2=K(Vdd-V_{th})^2$, where $V_{gs}$ is the voltage difference between the gate and the source of the driving transistor DTFT, $V_{th}$ is the threshold voltage of the driving transistor DTFT, and K is a constant related to the driving transistor DTFT per se. In addition, the source of the driving transistor DTFT is connected to the low level signal terminal Vss via the fourth transistor T4. Meanwhile, the voltage $V_a$ at the first node A is equal to Vdd ($V_a$=Vdd); the voltage $V_b$ at the second node B is equal to Vss ($V_b$=Vss); and the voltage $V_c$ at the third node C is equal to $V_{data}$ (data voltage) and therefore $V_L$ ($V_c=V_{data}-V_L$). Since the driving circuit I at this time is not the correct driving circuit I which is preset for the OLED, the fourth transistor T4 is turned on during the stage t1 for making the OLED shorted and preventing the OLED from emitting light, in order to prevent the OLED from generating light at an incorrect luminance strength.

During the stage t2, Scan=1, $V_{data}=V_L$, CR1=1, and CR2=0.

Figure 7:
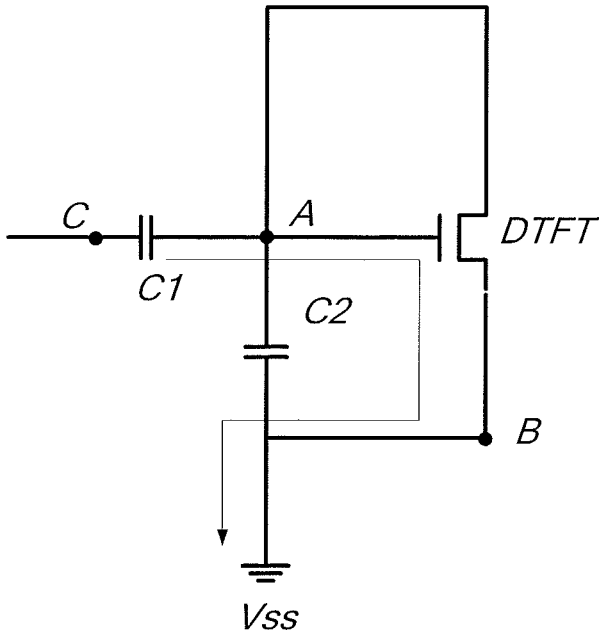
FIG. 7 is a schematic diagram of operation of the AMOLED driving circuit illustrated in FIG. 4 in stage t2.

The stage t2 is a discharging stage. As illustrated in FIG. 7, during the stage t2, since the row scan signal terminal Scan is at the high level, the first transistor T1 and the fourth transistor T4 continue to be turned on; since the first control signal terminal CR1 is at the high level, the second transistor T2 continue to be turned on; since the second control signal terminal CR2 is at the low level, the third transistor T3 is turned off. At this time, since the second transistor T2 is turned on but the third transistor T3 is turned off, the gate and the source of the driving transistor DTFT are connected together, and the drain of the transistor DTFT is disconnected from the third transistor T3, in which case the driving transistor DTFT works as a diode, and the first capacitor C1, the driving transistor DTFT and the low level signal terminal Vss together form a discharging loop (as shown by the arrow in FIG. 7) for discharging the first capacitor C1. This discharging procedure goes on until the voltage at the first node A falls to the threshold voltage $V_{th}$ of the driving transistor DTFT, and at this time, the driving transistor DTFT is at a critical turning-on status, and if the discharging continues, the driving transistor DTFT will be turned off, thus the discharging loop will disconnects and the discharging procedure ends. At this time, a voltage $V_{c1}$ between the two terminals of the first capacitor C1 is equal to $V_c-V_a=V_L-V_{th}$ ($V_{c1}=V_c-V_a-V_L-V_{th}$). The voltage $V_a$ at the first node A is equal to Vdd ($V_a$=Vdd); the voltage $V_b$ at the second node B is equal to Vss ($V_b$=Vss); and the voltage $V_c$ at the third node C is equal to $V_{data}$ ($V_c=V_{data}=V_L$). The fourth transistor T4 is turned on during the stage t2 for making the OLED shorted, so that the OLED is prevented from emitting light.

During the stage t3, Scan=1, Vdata=$V_H$, CR1=0, and CR2=0.

Figure 8:
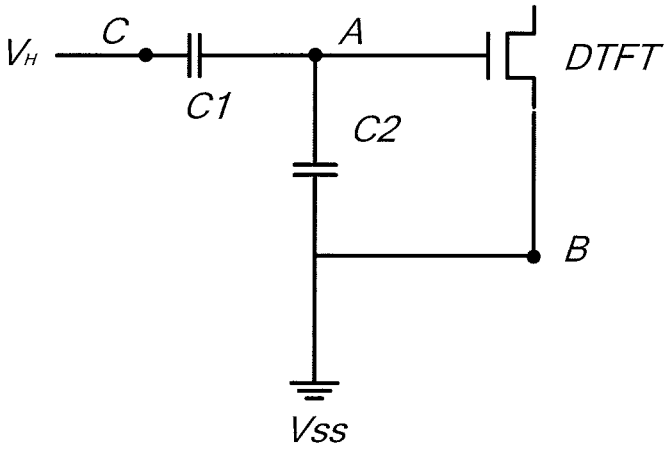
FIG. 8 is a schematic diagram of operation of the AMOLED driving circuit illustrated in FIG. 4 in stage t3.

The stage t3 is a voltage adjustment stage. As illustrated in FIG. 8, during the stage t3, since the row scan signal terminal Scan is at the high level, the first transistor T1 and the fourth transistor T4 continued to be turned on; since the first control signal terminal CR1 is at the low level, the second transistor T2 is turned off; since the CR2 is at the low level, the third transistor T3 is turned off. At this time, since the first transistor T1 is turned on, the data signal terminal Vdata is connected to the first capacitor C1 via the third node C, and since the Vdata becomes the high voltage $V_H$ from the low voltage $V_L$ sharply, the voltage at the third node C sharply changes to $V_H$ from $V_L$ correspondingly. Since both the second transistor T2 and the third transistor T3 are turned off, and the driving transistor DTFT is at the critical status and is not turned on, the first node A is in a floating status. When the voltage at the third node C changes sharply, the first capacitor C1 in the floating status can keep unchanged the charges at its respective ends, and thus the charges at the first node A remain unchanged also, and therefore the voltage at the first node A changes sharply accordingly. During the stage t3, the charges at the first node A can be expressed by a formula $Q_a=(V_a-V_c)\times C_2+(V_a-Vss)\times C_2$, where $Q_a$ represents the charges at the first node A, $C_1$ represents capacitance of the first capacitor C1, and $C_2$ represents capacitance of the second capacitor C2. Hereby, it can be known that the charges of the first node A before the sharp change of the voltage satisfy $(V_{th}-V_L)\times C_1+(V_{th}-Vss)\times C_2$, and the charges of the first node A after the sharp change of the voltage satisfy $(V_a-V_H)\times C_1+(V_a-Vss)\times C_2$. These results are equal to each other, i.e., $(V_{th}-V_L)\times C_1+(V_{th}-Vss)\times C_2=(V_a-V_H)\times C_1+(V_a-Vss)\times C_2$. It can be known that the voltage at the first node A changes to $V_a=V_{th}+(V_H-V_L)\times C_1/(C_1+C_2)$ sharply. Meanwhile, as for the voltage $V_a$ at the first node A, $V_a=V_{th}+(V_H-V_L)\times C_1/(C_1+C_2)$; as for the voltage $V_b$ at the second node B, $V_b$=Vss; and as for the voltage $V_c$ at the third node C, $V_c-V_{data}$(data voltage)=$V_H$.

During the stage t4, Scan=0, Vdata=$V_L$, CR1=0, and CR2=1.

Figure 9:
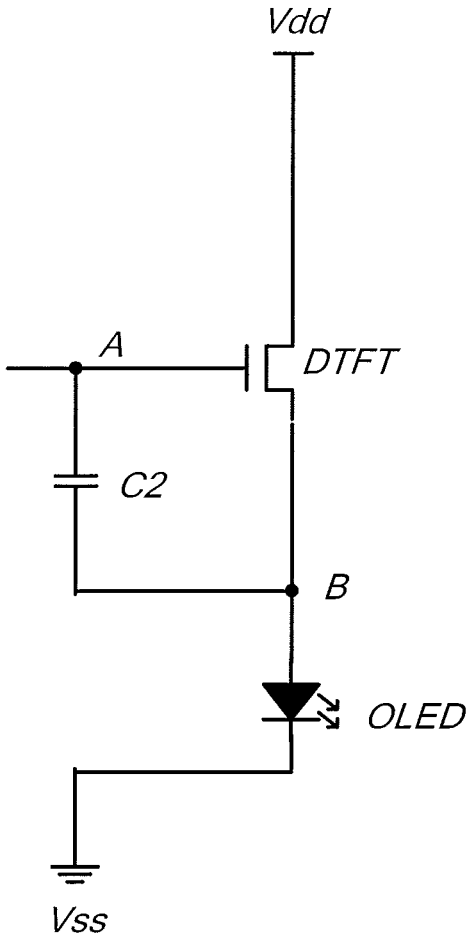
FIG. 9 is a schematic diagram of operation of the AMOLED driving circuit illustrated in FIG. 4 in stage t4.

The stage t4 is a driving stage. As illustrated in FIG. 9, during the stage t4, since the row scan signal terminal Scan is at the low level, the first transistor T1 and the fourth transistor T4 are turned off; since the first control signal terminal CR1 is at the low level, the second transistor T2 is turned off; since the second control signal terminal CR2 is at the high level, the third transistor T3 is turned on. At this time, since the voltage at the first node A rises to $V_{th}+(V_H-V_L)\times C_1/(C_1+C_2)$, the driving transistor DTFT is turned on and operates in the saturation status. At this time, the third transistor T3 is turned on also, and therefore the high level signal terminal Vdd, the third transistor T3, the driving transistor DTFT, the organic light emitting diode (OLED) and the low level signal terminal Vss together form a driving loop, and the driving current in the driving loop satisfy:

$$\begin{aligned} I &= K(V_{gs}-V_{th})^2 \\ &= K(V_{ab}-V_{th})^2 \\ &= K(V_{th}+(V_H-V_L)\times C_1/(C_1+C_2)-V_{th})^2 \\ &= K((V_H-V_L)\times C_1/(C_1+C_2))^2. \end{aligned}$$

It can be known that the driving current generated by the driving transistor DTFT in the saturation status is independent of its threshold voltage $V_{th}$, and thus the OLED can emit light with the stable driving current, so that the consistency of the driving circuit I can be ensured in a better way.

Thereafter, the AMOLED driving circuit repeats the stage t4 until the next stage t1 arrives. It can be known from the above descriptions that the driving current I for driving OLED to emit light is independent of the threshold voltage $V_{th}$ of the driving transistor DTFT during the stage t4, thus the threshold voltage $V_{th}$, will not affect the current flowing through the organic light emitting diode OLED, so that the consistency of the driving circuit can be ensured better, which brings about better uniformity of AMOLED brightness.

Figure 10:
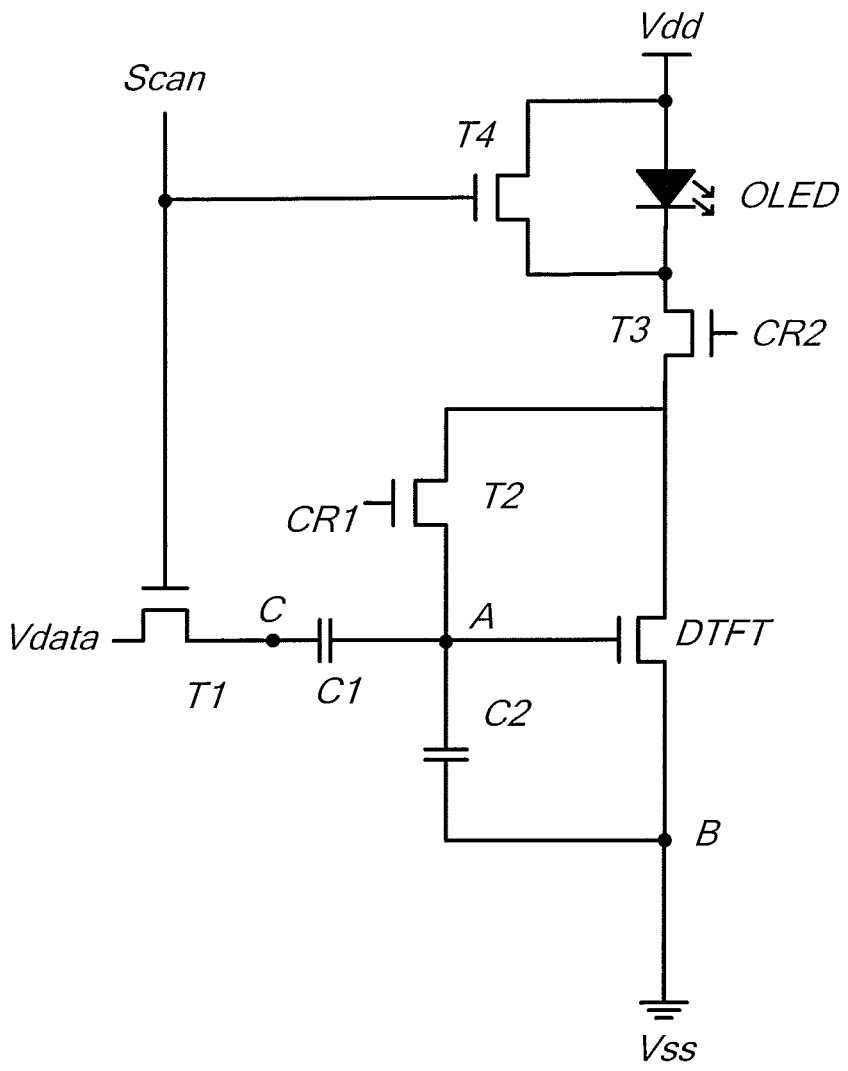
FIG. 10 is a schematic diagram of another embodiment of the AMOLED driving circuit.

In addition, FIG. 10 is an AMOLED driving circuit in another embodiment. The AMOLED driving circuit in this embodiment is basically the same as the AMOLED driving circuit in the embodiment illustrated in FIG. 4 except the connection position of the OLED. In the present embodiment, the OLED is connected between the high level signal terminal Vdd and the drain of the driving transistor DTFT. Specifically as shown in FIG. 10, the OLED is connected between the high level signal terminal Vdd and the drain of the third transistor T3. As for the AMOLED driving circuit illustrated in FIG. 10, the control timing chart thereof is the same as that shown in FIG. 5, and the operation procedure thereof is the same as that described above, thus detailed description is omitted here for simplicity. It needs to be noted that the difference in structure between the embodiment shown in FIG. 4 and that shown in FIG. 5 leads to some tiny difference of the final result. In the embodiment as shown in FIG. 10, since the OLED is connected between the source of the first transistor T4 and the low level signal terminal Vss, a voltage $V_{oled_in}$ will be generated across the two ends of the OLED in operation, that is, the $V_{oled_in}$ is the voltage across the OLED when it is emitting light. At this time, due to this voltage across the OLED, $V_q=Vss+V_{th}+(V_{ref}-V_{data})$; $V_n=Vss+V_{oled_in}$; and $V_{gs}=V_{qn}=(V_{ref}-V_{data})+V_{th}-V_{oled_in}$. Therefore, $I=k(V_{ref}-V_{data}-V_{oled_in})^2$ finally. In this way, the voltage $V_{oled_in}$ is introduced to the final result of the driving circuit I. The voltage $V_{oled_in}$ differs slightly when $V_{data}$ is at different gray level voltages, which brings forth somewhat instability during the circuit works. Therefore, the embodiment illustrated in FIG. 10 is different as compared with that illustrated in FIG. 4.

It should be understood that the technical schemes of the embodiments illustrated above in FIGS. 4 and 10 are not only suitable for polysilicon transistors but also suitable for other kinds of transistors in practice.

Moreover, another embodiment of the present disclosure also provides an active matrix organic light emitting diode (AMOLED) panel which comprises a plurality of sub-pixel units arranged in matrix, and one driving circuit as described above is provided in each of the sub-pixel units correspondingly. The driving circuit can be that as shown in FIG. 3, and for example, the AMOLED driving circuit shown in FIG. 4 or the AMOLED driving circuit shown in FIG. 10. The sub-pixel units of the AMOLED panel may comprise OLEDs for emitting red, green, and blue light respectively and therefore constitute red, green, and blue sub-pixel units. When the sub-pixel units emit light under control in a conventional way for example, colorful display can be realized.

With reference to FIG. 3, the AMOLED driving circuit in the AMOLED panel of the embodiment of the present disclosure includes two transistors, a capacitor, a organic light emitting diode, a voltage adjustment module, and input and output terminals. As for each AMOLED driving circuit, the input and output terminals include a row scan signal teiminal Scan, a data signal terminal Vdata, a first control signal terminal CR1, a second control signal terminal CR2, a high level signal terminal Vdd and a low level signal terminal Vss. In particular, the AMOLED driving circuit includes the following components and configuration.

A driving transistor DTFT comprises a gate connected to a second capacitor C2, a source connected to the low level signal terminal Vss, and a drain connected to the voltage adjustment module 1; the transistor DTFT acts as a driving transistor for providing a driving current to drive the OLED to emit light when the driving transistor DTFT works in a saturation status. A first transistor T1 comprises a gate connected to the row scan signal terminal Scan, a source connected to the voltage adjustment module 1, and a drain connected to the data signal terminal Vdata; the first transistor T1 acts as a switching transistor for controlling the input of the data signal terminal Vdata under the control of the row scan signal terminal Scan. A second capacitor C2 is connected between the gate of the driving transistor DTFT and the low level signal terminal Vss, and is used for providing a maintaining voltage to the gate of the driving transistor DTFT. The organic light emitting diode (OLED) is connected between the low level signal terminal Vss and a juncture of the source of the driving transistor DTFT with the second capacitor C2 (see the FIGS. 3 and 4), i.e., the source of the driving transistor DTFT is connected to the second capacitor C2 and then connected to the OLED; or in another example, the OLED is connected between the high level signal terminal Vdd and the drain of the driving transistor DTFT (see the FIG. 10). The OLED emits light under the action of the driving current of the driving transistor DTFT whereby the whole AMOLED panel can operate to display. The voltage adjustment module 1 is connected to the first control signal terminal CR1, the second control signal terminal CR2 and the high level signal terminal Vdd, and further is connected with the second capacitor C2, the driving transistor DTFT and the first transistor T1; and this voltage adjustment module 1 is used for adjusting a gate-source voltage $V_{gs}$ of the driving transistor DTFT connected with the second capacitor C2, such that the driving current I of the driving transistor DTFT in a saturation status is independent of the threshold voltage $V_{th}$ of the driving transistor DTFT.

In the AMOLED driving circuit provided by the embodiment of the present disclosure, since the gate-source voltage $V_{gs}$ of the driving transistor DTFT connected with the second capacitor C2 can be adjusted by the voltage adjustment module 1, the driving current I of the driving transistor DTFT in the saturation status is independent of its threshold voltage $V_{th}$, and the threshold voltage $V_{th}$ of the driving transistor DTFT will not affect the current flowing through the OLED, so that the consistency of the driving circuit I can be ensured in a better way, which renders good uniformity of AMOLED brightness.

Moreover, further another embodiment of the present disclosure also provides an AMOLED driving method. In this embodiment, the sub-pixel units of the AMOLED panel are driven with the above-described AMOLED driving circuits, such that in each of the driving circuit, the driving current of a driving transistor in the saturation status is independent of the threshold voltage of the driving transistor. The driving circuits of the AMOLED panel can include the driving circuits as shown in FIG. 3, FIG. 4, or FIG. 10 above, but this is not limitative, and the panel can further include other kinds of driving circuits.

In the AMOLED driving method provided by the embodiment of the present disclosure, the driving current of the driving transistor in the saturation status in the AMOLED driving circuit can be independent of its threshold voltage, thus the threshold voltage $V_{th}$ will not affect the current flowing through the OLED of the respective sub-pixel unit, so that the consistency of the driving circuit can be ensured better, which renders good uniformity of AMOLED brightness.

In the present embodiment, in order that the driving current of the driving transistor in the saturation status in the driving circuit is independent of its threshold voltage, a voltage adjustment module can be added to the driving circuit; this voltage adjustment module is adapted to adjust a gate-source voltage of the driving transistor, such that the driving current of the driving transistor in the saturation status is independent of its threshold voltage. The driving transistor means a transistor for providing a driving current to the respective OLED, and the threshold voltage means the threshold voltage of the driving transistor. The gate-source voltage $V_{gs}$ refers to a voltage difference between the gate voltage $V_g$ and the source voltage $V_s$ of the driving transistor. $V_{th}$ can be included as a component of $V_{gs}$ by adjusting $V_{gs}$ with the voltage adjustment module, such that the $V_{th}$ can be counteracted or offset because $I=K(V_{gs}-V_{th})^2$ and the driving circuit I is independent of the threshold voltage $V_{th}$ finally.

In order that the driving transistor in the driving circuit operates in the saturation status, the driving circuit can be constructed such that the difference value between the gate-source voltage of the driving transistor and the threshold voltage thereof is less than or equals to a source-drain voltage of the driving transistor, i.e., satisfying $V_{ds} \geq V_{gs}-V_{th}$. When the driving transistor operates in the saturation status, the driving circuit I of the driving transistor only depends on its gate-source voltage $V_{gs}$. At this time, the voltage adjustment module can only adjust the gate-source voltage $V_{gs}$, and therefore parameters to be adjusted are in a small number and thus the adjustment procedure is simple.

Several embodiments of an AMOLED panel and an AMOLED driving circuit and method therefor are provided in the above.

The above descriptions only present some embodiments of the present disclosure, and the protection scope of the present disclosure is not limited to these embodiments. Those skilled in the art can easily conceive modifications or alternations within the technical scope of the present disclosure. Therefore, the protection scope of the present disclosure should be defined by the following claims.

What is claimed is:

1. A driving circuit of an active matrix organic light emitting diode (AMOLED) panel, comprising a driving transistor, a first transistor, a second capacitor, an organic light emitting diode, and a voltage adjustment module, wherein the driving transistor comprises a gate which is connected to one terminal of the second capacitor, a source which is connected to the other terminal of the second capacitor, and a drain which is connected to the voltage adjustment module;

the first transistor comprises a gate which is connected to a row scan signal terminal, a source which is connected to the voltage adjustment module, and a drain which is connected to a data signal terminal;

the second capacitor is connected between the gate of the driving transistor and the source of the driving transistor;

the organic light emitting diode is connected between a low level signal terminal and the source of the driving transistor, or is connected between a high level signal terminal and the drain of the driving transistor; and the voltage adjustment module is connected to a first control signal terminal, a second control signal terminal and a high level signal terminal, and is further connected with the one terminal of the second capacitor, the gate of the driving transistor, and the source of the first transistor, for adjusting a gate-source voltage of the driving transistor such that a driving current of the driving transistor in a saturation status is independent of the threshold voltage of the driving transistor.

2. The driving circuit of an AMOLED panel according to claim 1, wherein the voltage adjustment module includes:

a second transistor, a gate of which is connected to the first control signal terminal, a source of which is connected to the one terminal of the second capacitor, and a drain of which is connected to the drain of the driving transistor;

a third transistor, a gate of which is connected to the second control signal terminal, a source of which is connected to the drain of the driving transistor, and a drain of which is connected to a high level signal terminal; and a first capacitor, which is connected between the source of the first transistor and the one terminal of the second capacitor.

3. The driving circuit of an AMOLED panel according to claim 2, wherein when the organic light emitting diode is connected between the high level signal terminal and the drain of the driving transistor, the organic light emitting diode is connected between the high level signal terminal and the drain of the third transistor.

4. The driving circuit of an AMOLED panel according to claim 3, further including a fourth transistor, a gate of which is connected to the row scan signal terminal, a source of which is connected to one end of the organic light emitting diode, and a drain of which is connected to the other end of the organic light emitting diode.

5. The driving circuit of an AMOLED panel according to claim 4, wherein the driving transistor and the first to fourth transistors are N-type transistors.

6. The driving circuit of an AMOLED panel according to claim 2, further including a fourth transistor, a gate of which is connected to the row scan signal terminal, a source of which is connected to the low level signal terminal, and a drain of which is connected to the other terminal of the second capacitor.

7. The driving circuit of an AMOLED panel according to claim 6, wherein the driving transistor and the first to fourth transistors are N-type transistors.

8. An active matrix organic light emitting diode (AMOLED) panel, comprising a plurality of sub-pixel units arranged in matrix, a driving circuit according to claim 1 being provided to each of the sub-pixel units.

9. The AMOLED panel according to claim 8, wherein the driving circuit comprises a voltage adjustment module including:

a second transistor, a gate of which is connected to the first control signal terminal, a source of which is connected to one terminal of the second capacitor, and a drain of which is connected to the drain of the driving transistor;

a third transistor, a gate of which is connected to the second control signal terminal, a source of which is connected to the drain of the driving transistor, and a drain of which is connected to a high level signal terminal; and a first capacitor, which is connected between the source of the first transistor and the one terminal of the second capacitor.

10. The AMOLED panel according to claim 9, wherein when the organic light emitting diode is connected between the high level signal terminal and the drain of the driving transistor, the organic light emitting diode is connected between the high level signal terminal and the drain of the third transistor.

11. The AMOLED panel according to claim 10, wherein the driving circuit further includes a fourth transistor, a gate of which is connected to the row scan signal terminal, a source of which is connected to one end of the organic light emitting diode, and a drain of which is connected to the other end of the organic light emitting diode.

12. The AMOLED panel according to claim 9, wherein the driving circuit further includes a fourth transistor, a gate of which is connected to the row scan signal terminal, a source of which is connected to the low level signal terminal, and a drain of which is connected to the other terminal of the second capacitor.

13. The AMOLED panel according to claim 12, wherein the driving transistor and the first to fourth transistors are N-type transistors.

14. A driving method of an active matrix organic light emitting diode (AMOLED) panel, comprising:

driving the AMOLED panel with the driving circuit according to the claim 1 for each sub-pixel units of the AMOLED panel, such that a driving current of the driving transistor under a saturation status in the driving circuit is independent of the threshold voltage of the driving transistor.

15. The driving method of an AMOLED pan & according to claim 14, wherein a gate-source voltage of the driving transistor is adjusted such that the driving current of driving transistor in the saturation status is independent of its threshold voltage.

16. The driving method of an AMOLED panel according to claim 15, wherein driving circuit comprises a voltage adjustment module including:

a second transistor, a gate of which is connected to the first control signal terminal, a source of which is connected to one terminal of the second capacitor, and a drain of which is connected to the drain of the driving transistor;

a third transistor, a gate of which is connected to the second control signal terminal, a source of which is connected to the drain of the driving transistor, and a drain of which is connected to a high level signal terminal; and a first capacitor, which is connected between the source of the first transistor and the one terminal of the second capacitor.

17. The driving method of an AMOLED panel according to claim 16, wherein when the organic light emitting diode is connected between the high level signal terminal and the drain of the driving transistor, the organic light emitting diode is connected between the high level signal terminal and the drain of the third transistor.

18. The driving method of an AMOLED panel according to claim 17, wherein the driving circuit further includes a fourth transistor, a gate of which is connected to the row scan signal terminal, a source of which is connected to one end of the organic light emitting diode and a drain of which is connected to the other end of the organic light emitting diode.

19. The driving method of an AMOLED panel according to claim 16, wherein the driving circuit further includes a fourth transistor, a gate of which is connected to the row scan signal terminal, a source of which is connected to the low level signal terminal, and a drain of which is connected to the other terminal of the second capacitor.

20. The driving method of an AMOLED panel according to claim 19, wherein the driving transistor and the first to fourth transistors are N-type transistors.

* * * * *